US009022043B1

(12) United States Patent
Lujan-Puckett et al.

(10) Patent No.: US 9,022,043 B1
(45) **Date of Patent: *May 5, 2015**

(54) HAIR HOLDER SYSTEM

(71) Applicants: Felicia F. Lujan-Puckett, Tucson, AZ (US); Albert W. Puckett, Tucson, AZ (US)

(72) Inventors: Felicia F. Lujan-Puckett, Tucson, AZ (US); Albert W. Puckett, Tucson, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/902,101

(22) Filed: May 24, 2013

Related U.S. Application Data

(63) Continuation-in-part of application No. 13/114,914, filed on May 24, 2011, now Pat. No. 8,485,202.

(60) Provisional application No. 61/348,149, filed on May 25, 2010.

(51) Int. Cl.
*A45D 8/14* (2006.01)
*A45D 8/16* (2006.01)
*A45D 8/00* (2006.01)

(52) U.S. Cl.
CPC ..... *A45D 8/00* (2013.01)

(58) Field of Classification Search
USPC ..... 132/273, 275–276; 24/72.5, 712.7, 24/136 L, 578.13, 612, 459, 472, 474; D28/39–43; 63/43
See application file for complete search history.

(56) References Cited

U.S. PATENT DOCUMENTS

| | | | | | |
|---|---|---|---|---|---|
| 491,199 | A * | 2/1893 | Swartz | 54/74 |
| 931,308 | A * | 8/1909 | Honsowetz | 24/472 |
| 3,530,550 | A * | 9/1970 | White | 24/464 |
| 4,308,647 | A * | 1/1982 | Gillis | 24/460 |
| 4,493,332 | A * | 1/1985 | Burger | 132/275 |
| 4,913,174 | A * | 4/1990 | Cusenza | 132/278 |
| 5,511,289 | A * | 4/1996 | Melia | 24/66.9 |
| 6,053,182 | A * | 4/2000 | Harmell | 132/275 |
| 6,131,585 | A * | 10/2000 | Reinstein et al. | 132/275 |
| 6,397,857 | B2 * | 6/2002 | Neary | 132/275 |
| 6,446,638 | B1 * | 9/2002 | Horman | 132/275 |

* cited by examiner

*Primary Examiner* — Rachel Steitz
*Assistant Examiner* — Jennifer Gill

(57) ABSTRACT

A hair holder system featuring an outer component having a slot disposed therein and an insertion component that can slideably insert snugly into the slot of the outer component. When the insertion component is within the slot, the slot surface and the outer surface of the insertion component can clamp and hold hair therein between, thereby creating a bun or puff effect for hair inserted therethrough. The bun or puff effect is shaped according to the shape of the insertion component.

11 Claims, 17 Drawing Sheets

HAIR HOLDER SYSTEM

CROSS REFERENCE

This application is a continuation-in-part of U.S. patent application Ser. No. 13/114,914 filed May 24, 2011, which claims priority to U.S. provisional application Ser. No. 61/348,149 filed May 25, 2010, the specifications of which are incorporated herein by reference in their entirety.

FIELD OF THE INVENTION

The present invention is directed to a system for holding hair. However, the present invention is not limited to use with hair and can, for example, be used on clothing.

BACKGROUND OF THE INVENTION

Hair holder systems such as barrettes, ponytail holders, and hair clips are popular systems used to hold hair and provide a user with an accessory with which he/she can add style to his/her wardrobe. The present invention features novel hair holder systems. Generally, the hair holder system comprises an outer component and an insertion component adapted to slide into and secure into a slot in the outer component, thereby sandwiching hair to create a unique look. The present invention is not limited to use as a hair holder system. For example, the present invention may alternatively be used on clothing as an accessory.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a hair holder system (100) comprising: (a) an outer component (110) having a slot (118) disposed therein, the slot (118) has a slot surface (119), a decorative component (220) is disposed on a top surface (111) of the outer component (110); and (b) an insertion component (120) having an outer edge (125), the outer edge (125) can slidably insert into the slot (118) of the outer component (110). When the insertion component (120) is disposed within the slot (118), the slot surface (119) and the outer surface of the insertion component (120) can clamp and hold hair therein between, wherein a bun or puff effect is created for hair inserted therethrough in various shapes depending on a shape of the insertion component (120).

In some embodiments, the outer component (110) and insertion component (120) are connected together via a first pair of tethers (330*a*) and a second pair of tethers (330*a*), the first pair of tethers (330*a*) comprises a first tether (130*a*) and a third tether (130*c*), the second pair of tethers (330*b*) comprises a second tether (130*b*) and a fourth tether (130*d*), the first pair of tethers (330*a*) is positioned opposite the second pair of tethers (330*b*).

In some embodiments, a first end (131*a*) of the first tether (130*a*) is attached to the bottom surface (112) of the outer component (110) adjacent to an inner rim (119*a*) of the outer component (110) and a second end (132*a*) of the first tether (130*a*) is attached to the outer edge (125) of the insertion component (120), and a first end (131*c*) of the third tether (130*c*) is attached to the bottom surface (112) of the outer component (110) adjacent to the inner rim (119*a*) of the outer component (110) and a second end (132*c*) of the third tether (130*c*) is attached to the outer edge (125) of the insertion component (120).

In some embodiments, a first end (131*b*) of the second tether (130*b*) is attached to the bottom surface (112) of the outer component (110) adjacent to the inner rim (119*a*) of the outer component (110) and a second end (132*b*) of the second tether (130*b*) is attached to the outer edge (125) of the insertion component (120), and a first end (131*d*) of the fourth tether (130*d*) is attached to the bottom surface (112) of the outer component (110) adjacent to the inner rim (119*a*) of the outer component (110) and a second end (132*d*) of the fourth tether (130*d*) is attached to the outer edge (125) of the insertion component (120).

In some embodiments, the decorative component (220) includes a flower, a bead, glitter, or a combination thereof. In some embodiments, the outer component (110) is between about 0.1 to 0.5 inches in thickness as measured from the slot surface (119) to a side surface (113). In some embodiments, the outer component (110) is between about 0.5 to 1 inch in thickness as measured from the slot surface (119) to a side surface (113). In some embodiments, a gap (180) is disposed between the slot surface (119) of the outer component (110) and the outer surface (125) of the insertion component (120), the gap (180) is between about 0.05 and 0.25 inches.

The present invention also features a hair holder system (100) comprising: (a) an outer component (110) having a slot (118) disposed therein, the slot (118) has a slot surface (119); (b) an insertion component (120) having an outer edge (125), the outer edge (125) can slidably insert into the slot (118) of the outer component (110). When the insertion component (120) is disposed within the slot (118), the slot surface (119) and the outer surface of the insertion component (120) can clamp and hold hair therein between, wherein a bun or puff effect is created for hair inserted therethrough in various shapes depending on a shape of the insertion component (120); and (c) a gripping component (160) disposed on at least a portion of one or both of the slot surface (119) of the outer component (110) or the outer surface (125) of the insertion component (120), the gripping component (160) functions to help secure the insertion component (120) within the slot (118) of the outer component when hair is inserted therethrough between the insertion component (120) and the outer component (110).

In some embodiments, the outer component (110) and insertion component (120) are connected together via a first pair of tethers (330*a*) and a second pair of tethers (330*a*), the first pair of tethers (330*a*) comprises a first tether (130*a*) and a third tether (130*c*), the second pair of tethers (330*b*) comprises a second tether (130*b*) and a fourth tether (130*d*), the first pair of tethers (330*a*) is positioned opposite the second pair of tethers (330*b*).

In some embodiments, a first end (131*a*) of the first tether (130*a*) is attached to the bottom surface (112) of the outer component (110) adjacent to an inner rim (119*a*) of the outer component (110) and a second end (132*a*) of the first tether (130*a*) is attached to the outer edge (125) of the insertion component (120), and a first end (131*c*) of the third tether (130*c*) is attached to the bottom surface (112) of the outer component (110) adjacent to the inner rim (119*a*) of the outer component (110) and a second end (132*c*) of the third tether (130*c*) is attached to the outer edge (125) of the insertion component (120).

In some embodiments, a first end (131*b*) of the second tether (130*b*) is attached to the bottom surface (112) of the outer component (110) adjacent to the inner rim (119*a*) of the outer component (110) and a second end (132*b*) of the second tether (130*b*) is attached to the outer edge (125) of the insertion component (120), and a first end (131*d*) of the fourth tether (130*d*) is attached to the bottom surface (112) of the outer component (110) adjacent to the inner rim (119*a*) of the outer component (110) and a second end (132*d*) of the fourth tether (130*d*) is attached to the outer edge (125) of the insertion component (120).

In some embodiments, the gripping component (160) is be constructed from a material comprising foam, rubber, elastic, cotton, mesh, a hook-and-loop fastener component, or a combination thereof. In some embodiments, the gripping component (160) is disposed on the slot surface (119) in between a top surface (111) and a bottom surface (112) of the outer component (110). In some embodiments, the gripping component (160) is disposed on the slot surface (119) of the outer component (110) near or at a bottom surface (112) of the outer component (110). In some embodiments, the gripping component (160) is disposed on the outer surface (125) in between a top surface (121) and a bottom surface (122) of the insertion component (120). In some embodiments, the gripping component (160) is disposed on the outer surface (125) of the insertion component (120) near or at a bottom surface (122) of the insertion component (120).

In some embodiments, the system (100) further comprises a decorative component (220) disposed on a top surface (111) of the outer component (110). In some embodiments, the outer component (110) is between about 0.1 to 0.5 inches in thickness as measured from the slot surface (119) to a side surface (113). In some embodiments, the outer component (110) is between about 0.5 to 1 inch in thickness as measured from the slot surface (119) to a side surface (113). In some embodiments, a gap (180) is disposed between the slot surface (119) of the outer component (110) and the outer surface (125) of the insertion component (120), the gap (180) is between about 0.05 and 0.25 inches.

The present invention also features a hair holder system (100) comprising: (a) an outer component (110) having a slot (118) disposed therein, the slot (118) has a slot surface (119); (b) an insertion component (120) having an outer edge (125), the outer edge (125) can slidably insert into the slot (118) of the outer component (110), when the insertion component (120) is disposed within the slot (118), the slot surface (119) and the outer surface of the insertion component (120) can clamp and hold hair therein between, wherein a bun or puff effect is created for hair inserted therethrough in various shapes depending on a shape of the insertion component (120); and (c) a first tether (130*a*) and a second tether (130*b*) that both connect the outer component (110) and the insertion component (120), the first tether (130*a*) and second tether (130*b*) are positioned opposite each other, wherein a first end (131*a*) of the first tether (130*a*) is attached to the outer component (110) and a second end (132*a*) of the first tether (130*a*) is attached to the insertion component (120), a first end (131*b*) of the second tether (130*b*) is attached to the outer component (110), and a second end (132*b*) of the second tether (130*b*) is attached to the insertion component (120).

In some embodiments, the first ends (131) of the tethers (130) attach to the slot surface (119) of the outer component (110) in or near a center of the outer component (110). In some embodiments, the first ends (131) of the tethers (130) attach to the slot surface (119) of the outer component (110) at or near a top surface (111) of the outer component (110). In some embodiments, the first ends (131) of the tethers (130) attach to the slot surface (119) of the outer component (110) at or near a bottom surface (112) of the outer component (110). In some embodiments, the first ends (131) of the tethers (130) attach to the bottom surface (112) of the outer component (110). In some embodiments, the second ends (132) of the tethers (130) attach to the outer surface (125) of the insertion component (120) in a center of the insertion component (120).

In some embodiments, the second ends (132) of the tethers (130) attach to the outer surface (125) of the insertion component (120) at or near a top surface (121) of the insertion component (120). In some embodiments, the second ends (132) of the tethers (130) attach to the outer surface (125) of the insertion component (125) at or near a bottom surface (122) of the insertion component (120). In some embodiments, the second ends (132) of the tethers (130) attach to a top surface (121) of the insertion component (120). In some embodiments, the second ends (132) of the tethers (130) attach to a bottom surface (122) of the insertion component (120). In some embodiments, the outer component (110) is between about 0.1 to 0.5 inches in thickness as measured from the slot surface (119) to a side surface (113). In some embodiments, the outer component (110) is between about 0.5 to 1 inch in thickness as measured from the slot surface (119) to a side surface (113). In some embodiments, a gap (180) is disposed between the slot surface (119) of the outer component (110) and the outer surface (125) of the insertion component (120), the gap (180) is between about 0.05 and 0.25 inches.

In some embodiments, the system further comprises a gripping component (160) disposed on at least a portion of one or both of the slot surface (119) of the outer component (110) or the outer surface (125) of the insertion component (120), the gripping component (160) functions to help secure the insertion component (120) within the slot (118) of the outer component when hair is inserted therethrough between the insertion component (120) and the outer component (110).

DESCRIPTION OF PREFERRED EMBODIMENTS

Figure 1:
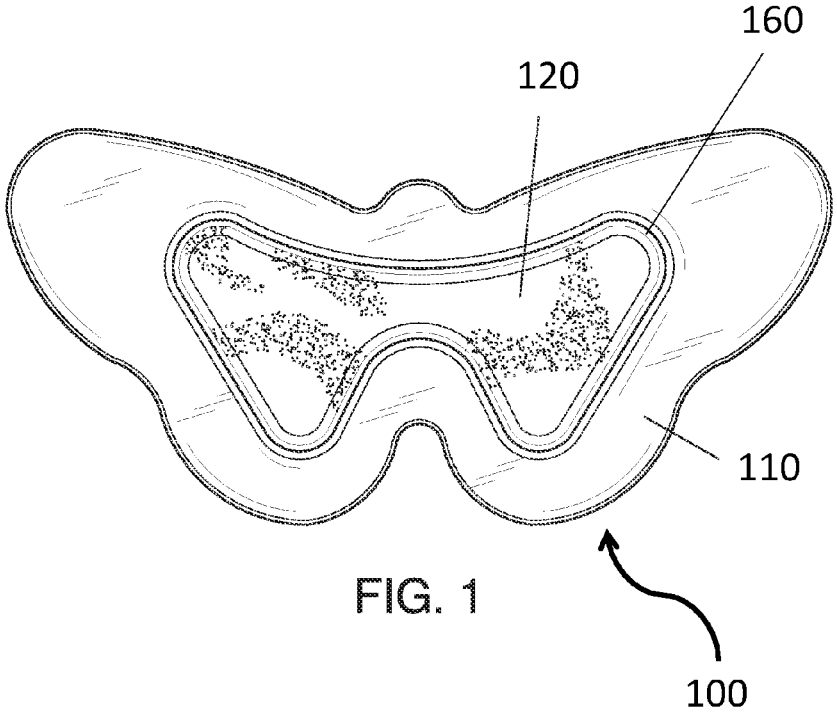
FIG. 1 is a top view of a system of the present invention.
Figure 2:
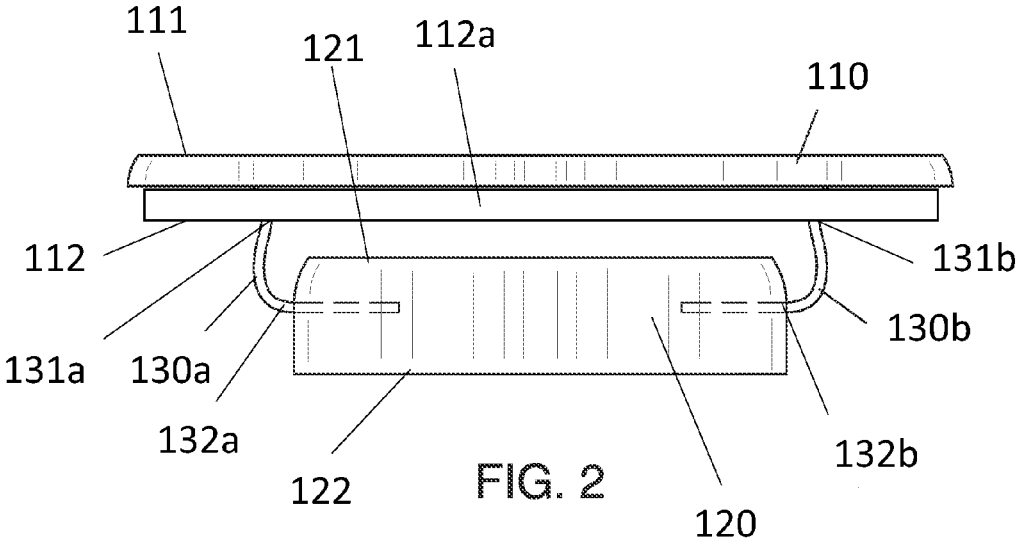
FIG. 2 is a side view of the system of FIG. 1.
Figure 3:
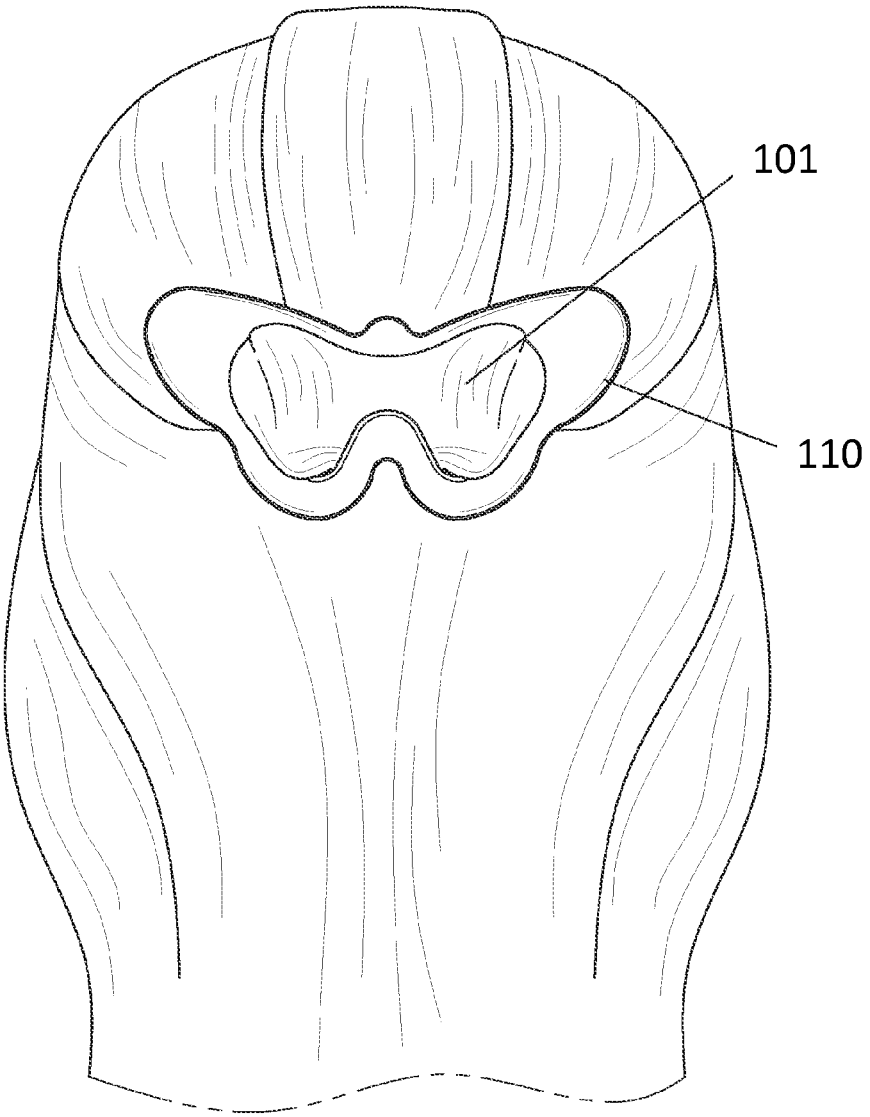
FIG. 3 is an in-use view of the system of FIG. 1.

Referring now to FIG. 1-20, the present invention features novel hair holder systems (100). The present invention is not limited to use as a hair holder system. For example, the present invention may alternatively be used on clothing as an accessory.

System Components

The hair holder system (100) comprises an outer component (110) having a top surface (111) and a bottom surface (112). The outer component (110) may be constructed in a variety of shapes including but not limited to a butterfly shape, a flower shape, an animal shape, a star shape, a heart shape, a moon shape, a sun shape, a peace sign shape, a geometrical shape (e.g., a circle, a square, a rectangle, an oval shape, a diamond shape), the like, or a combination thereof. The outer component (110) may be generally flat (e.g., the top surface (111) is generally flat), however the outer component (110) is not limited to being flat. For example, in some embodiments, the top surface (111) of the outer component (110) is rounded.

The outer component (110) has a slot (118) disposed therein, for example in the center portion of the outer component (110). The slot (118) has a slot surface (119) (e.g., an inner surface). In some embodiments, more than one slot (118) is disposed in the outer component (110) (e.g., three slots (118)). In some embodiments, two slots (118) are disposed in the outer component (110). In some embodiments, three slots (118) are disposed in the outer component (110). In some embodiments, four slots (118) are disposed in the outer component (110). In some embodiments, more than four slots (118) are disposed in the outer component (110).

The system (100) further comprises an insertion component (120) for inserting into the slot (118) in the outer component. The insertion component (120) has a top surface (121), a bottom surface (122), and an outer edge (125). The outer edge (125) of the insertion component (120) slidably inserts into the slot (118) of the outer component (110) (e.g., in the slot surface (119)). In some embodiments, the outer edge (125) of the insertion component (120) snugly inserts into the slot (118) of the outer component (110) (e.g., in the slot surface (119)).

The insertion component (120) may be constructed in a variety of shapes including but not limited to a butterfly shape, a flower shape, an animal shape, a star shape, a heart shape, a moon shape, a sun shape, a peace sign shape, a geometrical shape (e.g., a circle, an oval shape, a diamond shape, a rectangle shape, etc.), the like, or a combination thereof. The insertion component (120) may be generally flat (e.g., the top surface (121) is generally flat), however the insertion component (120) is not limited to being flat. For example, in some embodiments, the top surface (121) of the insertion component (120) is rounded.

The outer component (110) and the insertion component (120) do not need to be the same shape. For example, in some embodiments, the outer component (110) is a circle and the insertion component (120) is a butterfly or a heart. In some embodiments, the shape of the slot (118) and the shape of the insertion component (120) match. In some embodiments, the size of the slot (118) and the size of the insertion component (120) match or nearly match. The insertion component (120) and/or outer component (110) may come in one or more pieces.

When the insertion component (120) is disposed within the slot (118), the slot surface (119) and the outer surface (125) of the insertion component (120) can clamp and hold hair (101) therein between (e.g., hair (101) is sandwiched between the slot surface (119) and the outer surface (125) of the insertion component (120)). This can create a bun or puff effect for hair (101) inserted therethrough. Hair may be fed through the slot (118) in a ponytail fashion instead of a traditional bun fashion. The bun or puff effect has a shape that depends on the shape of the insertion component (120). For example, a butterfly-shaped insertion component (120) provides a butterfly-shaped puff effect. Any appropriate shape may be configured with the present invention.

In some embodiments, the system (100) comprises more than one insertion component (120). For example, in some embodiments, the system (100) comprises two insertion components (120). In some embodiments, the system comprises three insertion components (120). In some embodiments, the system comprises more than three insertion components (120) (e.g., four insertion components (120), five insertion components (120), etc.). In some embodiments, the multiple insertion components (120) may be held together via an insertion component base (129). Generally, the number of insertion components (120) is the same as the number of slots (118), however the system (100) of the present invention is not limited to this configuration (e.g., the number of slots (118) may exceed the number of insertion components (120). In some embodiments, the base is constructed from a material comprising plastic.

Gripping Component

The system (100) may feature components for helping to secure the insertion component (120) within the outer component (110), e.g., when hair is sandwiched between the insertion component (120) and the outer component (110). In some embodiments, the at least a portion of the slot surface (119) of the outer component (110) is lined (e.g., the slot surface (119) is at least partially lined or fully lined) with a gripping component (160). In some embodiments, the at least a portion of the outer surface (125) of the insertion component (120) is lined (e.g., the outer surface (125) is at least partially lined or fully lined) with a gripping component (160). The gripping component (160) may help provide amore snug fit between the insertion component (120) and the outer component (110). The gripping component (160) may be constructed from a variety of materials. For example, in some embodiments, the gripping component (160) may be constructed from a material comprising foam, rubber, elastic, cotton, mesh, a hook-and-loop fastener (e.g., the hook portion of the hook-and-loop fastener, the loop portion of the hook-and-loop fastener), the like, or a combination thereof.

The gripping component (160) may be in any location on the outer component (110). For example, as shown in FIG. 13, in some embodiments, the gripping component (160) extends on the slot surface (119) from the top surface (111) of the outer component (110) to the bottom surface (112) of the outer component (110) (see FIG. 13(A)). In some embodiments, the gripping component (160) is disposed on the slot surface (119) in between the top surface (111) and the bottom surface (112) of the outer component (110) (see FIG. 13(B)). In some embodiments, the gripping component (160) is disposed on the slot surface (119) of the outer component (110) near or at the bottom surface (112) of the outer component (110) (see FIG. 13(C)). In some embodiments, the gripping component (160) is disposed on the slot surface (119) of the outer component (110) at the bottom surface (112) and also on the bottom surface (112) of the outer component (110) (see FIG. 13(D)). The placement of the gripping component (160) is not limited to the aforementioned positions and configurations.

The gripping component (160) may be in any location on the insertion component (120). For example, as shown in FIG. 14, in some embodiments, the gripping component (160) extends on the outer surface (125) from the top surface (121) of the insertion component (120) to the bottom surface (122) of the insertion component (120) (see FIG. 14(A)). In some embodiments, the gripping component (160) is disposed on the outer surface (125) in between the top surface (121) and the bottom surface (122) of the insertion component (120) (see FIG. 14(B)). In some embodiments, the gripping component (160) is disposed on the outer surface (125) of the insertion component (120) near or at the bottom surface (122) of the insertion component (120) (see FIG. 14(C)). In some embodiments, the gripping component (160) is disposed on the outer surface (125) of the insertion component (120) at the bottom surface (122) and also on the bottom surface (122) of the insertion component (120) (see FIG. 14(D)). The placement of the gripping component (160) is not limited to the aforementioned positions and configurations.

In some embodiments, the gripping component (160) is disposed continuously around the slot surface (119) of the outer component (110) (e.g., see FIG. 1). The gripping component (160) may alternatively be disposed on just a portion of the slot surface (119) of the outer component (110), e.g., not continuously around the inner circumference of the slot surface (119). In some embodiments, the gripping component (160) is disposed continuously around the outer surface (125) of the insertion component (120). The gripping component (160) may alternatively be disposed on just a portion of the outer surface (125) of the insertion component (120), e.g., not continuously around the outer circumference of the outer surface (125).

Figure 7:
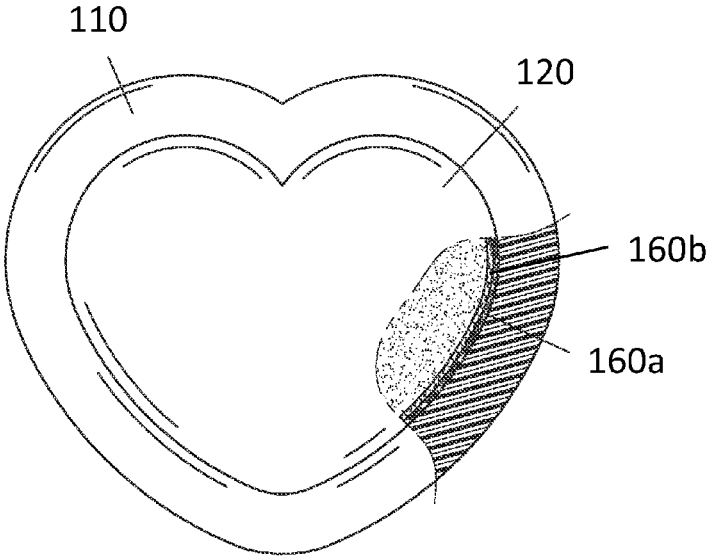
FIG. 7 is a top view of a system of the present invention.
Figure 9:
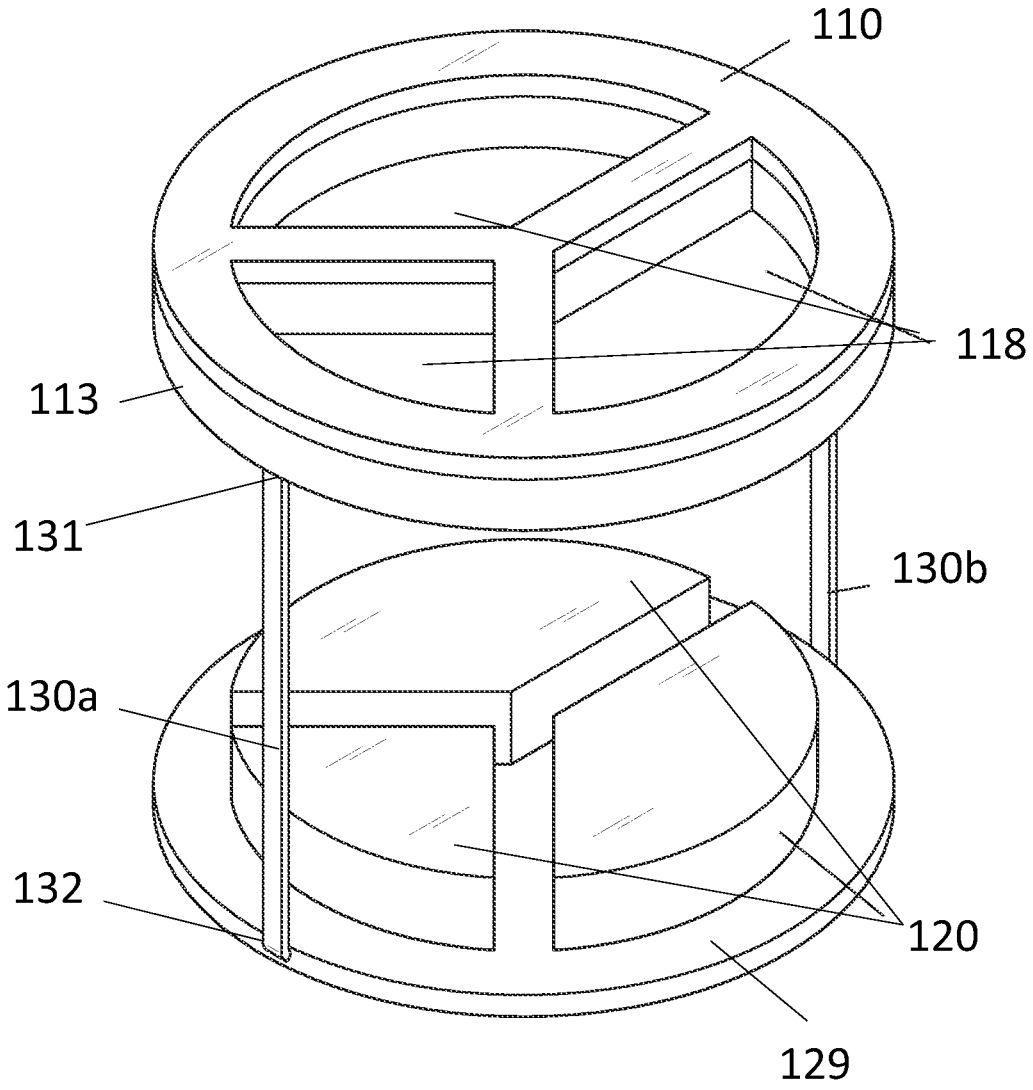
FIG. 9 is a perspective view of a system of the present invention.
Figure 10:
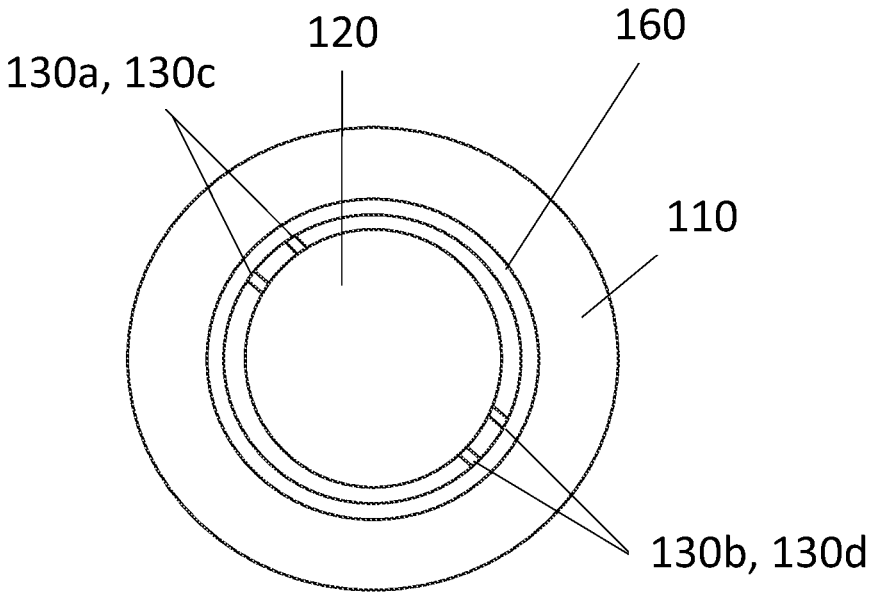
FIG. 10 is a top view of the system of FIG. 8.
Figure 15:
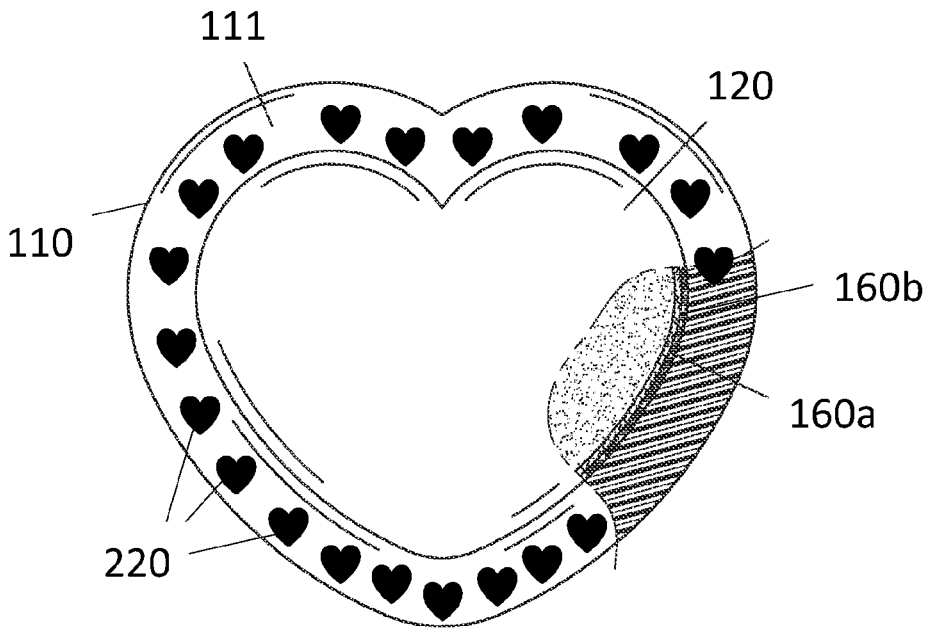
FIG. 15 shows a top view of a system of the present invention, wherein decorative components (heart-shaped beads) are disposed on the top surface of the outer component.

In some embodiments, a gripping component (160) is disposed on both the slot surface (119) of the outer component (110) and the outer surface (125) of the insertion component (120). For example, FIG. 7 and FIG. 15 show a first gripping component (160*a*) disposed on the slot surface (119) of the outer component (110) and a second gripping component (160*b*) disposed on the outer surface (125) of the insertion component (120).

Connection of Insertion Component to Outer Component

The outer component (110) and the insertion component (120) may be connected, e.g., via one or more tethers (130) or pairs of tethers (130). The tethers (130) each a first end (131) attached to the outer component (110) and a second end (132) attached to the insertion component (120).

The tethers (130) may attach to any portion of the insertion component (120) and/or outer component (110). The tethers (130) may optionally be fixedly attached to the insertion component (120) and/or outer component (110), or the tethers (130) may be removably attached to the insertion component (120) and/or outer component (110). In some embodiments, the tethers (130) are directly attached to the outer component (110) and/or insertion component (120). In some embodiments, the tethers are attached to the outer component (110) and/or insertion component (120) via an attachment means, for example a hook (199) (e.g., see FIG. 19, FIG. 20).

In some embodiments, a first tether (130*a*) and a second tether (130*b*) may connect the outer component and the insertion component (120). In some embodiments, the first tether (130*a*) is positioned opposite the second tether (130*b*). For example, the position where the first end (131*a*) of the first tether (130*a*) is attached to the outer component (110) and the position where the first end (131*b*) of the second tether (130*b*) is attached to the outer component (110) are opposite each other. Or, the position where the second end (132*a*) of the first tether (130*a*) is attached to the insertion component (120) and the position where the second end (132*b*) of the second tether (130*b*) is attached to the insertion component (120) are opposite each other.

In some embodiments, the outer component (110) and the insertion component (120) are connected by more than two tethers (130), for example three tethers (130), four tethers (130) (e.g., two pairs of tethers), five tethers (130), or more than five tethers (130).

Figure 8:
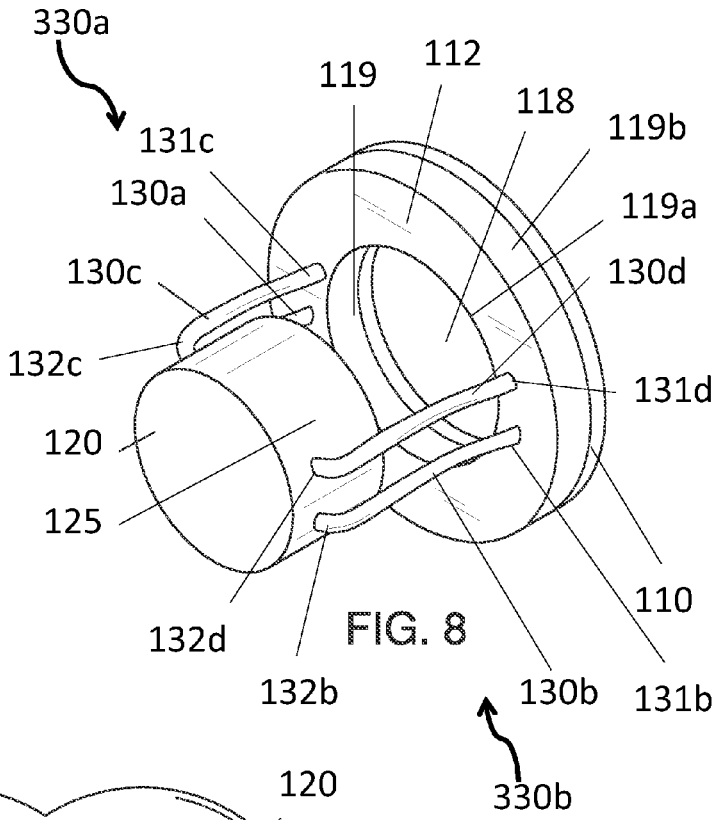
FIG. 8 is a perspective view of a system of the present invention.

In some embodiments, two pairs of tethers (130) connect the outer component (110) and the insertion component (120) as shown in FIG. 8. For example, in some embodiments, a first pair of tethers (330*a*) and a second pair of tethers (330*b*) connect the outer component (110) and the insertion component (120). The first pair of tethers (330*a*) may be positioned opposite the second pair of tethers (330*b*). The first pair of tethers (330*a*) comprises a first tether (130*a*) and a third tether (130*c*). The second pair of tethers (330*b*) comprises a second tether (130*b*) and a fourth tether (130*d*).

The first end (131*a*) of the first tether (130*a*) is attached to the outer component (110), e.g., the bottom surface (112) of the outer component (110) adjacent to the inner rim (119*a*) of the outer component (110). The second end (132*a*) of the first tether (130*a*) is attached to the insertion component (120), e.g., the outer edge (125) of the insertion component (120). The first end (131*c*) of the third tether (130*c*) is attached to the outer component (110), e.g., the bottom surface (112) of the outer component (110) adjacent to the inner rim (119*a*) of the outer component (110). The second end (132*c*) of the third tether (130*c*) is attached to the insertion component, e.g., the outer edge (125) of the insertion component (120). The first end (131*b*) of the second tether (130*b*) is attached to the outer component (110), e.g., the bottom surface (112) of the outer component (110) adjacent to the inner rim (119*a*) of the outer component (110). The second end (132*b*) of the second tether (130*b*) is attached to the insertion component (120), e.g., the outer edge (125) of the insertion component (120). The first end (131*d*) of the fourth tether (130*d*) is attached to the outer component (110), e.g., the bottom surface (112) of the outer component (110) adjacent to the inner rim (119*a*) of the outer component (110). The second end (132*d*) of the fourth tether (130*d*) is attached to the insertion component (120), e.g., the outer edge (125) of the insertion component (120). The present invention is not limited to this number and configuration of tethers.

The first end (131) of the tether (130) may attach to any part of the outer component (110). For example, as shown in FIG.

11A, in some embodiments, the first end (131) of the tether (130) attaches to the slot surface (119) of the outer component (110) in the center (or near the center) of the outer component (110). In some embodiments, the first end (131) of the tether (130) attaches to the slot surface (119) of the outer component (110) at or near the top surface (111) of the outer component (110). In some embodiments, the first end (131) of the tether (130) attaches to the slot surface (119) of the outer component (110) at or near the bottom surface (112) of the outer component (110). In some embodiments, the first end (131) of the tether (130) attaches to the top surface (111) of the outer component (110). In some embodiments, the first end (131) of the tether (130) attaches to the bottom surface (112) of the outer component (110).

Figure 11A:
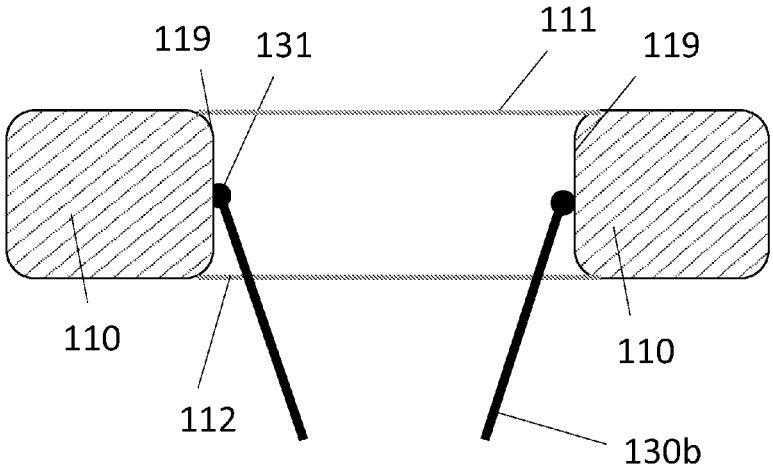
FIG. 11A-11C show perspective views of systems of the present invention. For clarity, only the outer component is shown. The tethers may attach to the outer component at various locations along the slot surface of the outer component, or to the top surface or bottom surface of the outer component.
Figure 11B:
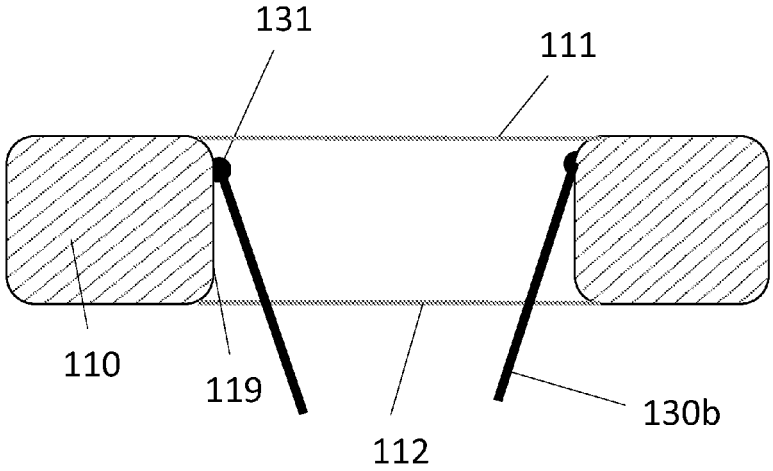
Figure 11C:
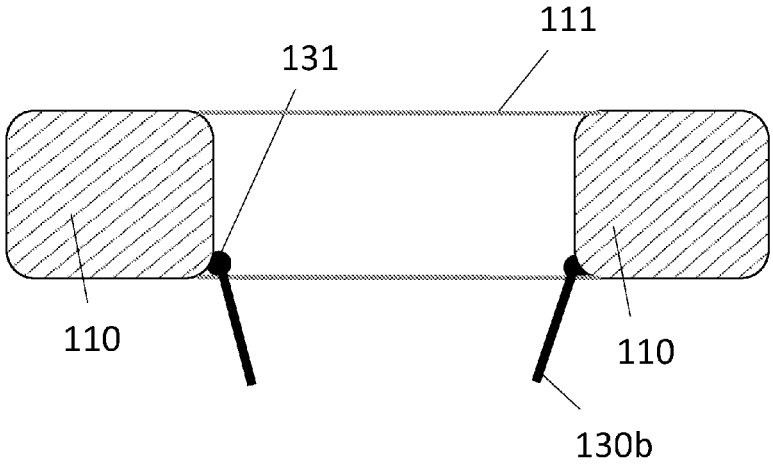
Figure 11D:
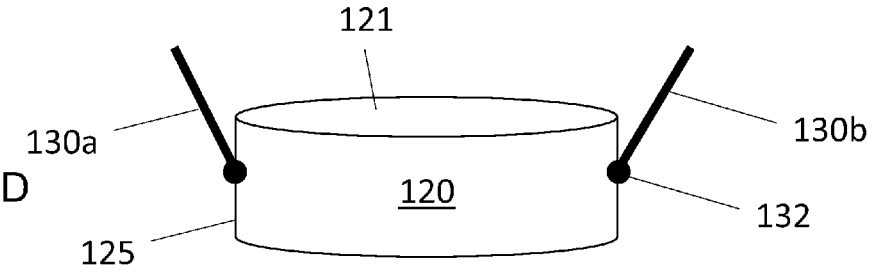
FIG. 11D-11G show perspective views of systems of the present invention. For clarity, only the insertion component is shown. The tethers may attach to the insertion component at various locations along the outer surface of the insertion component, or to the top surface or bottom surface of the insertion component.
Figure 11E:
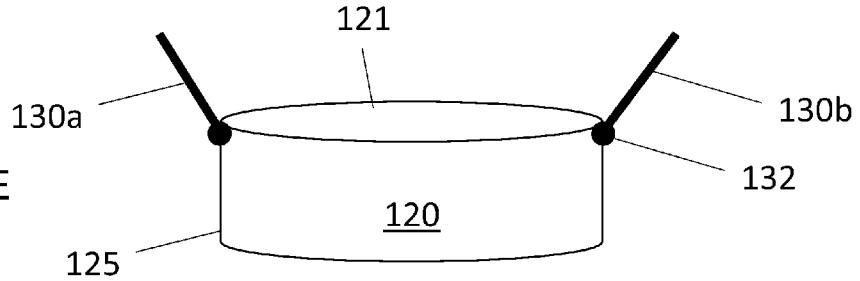
Figure 11F:
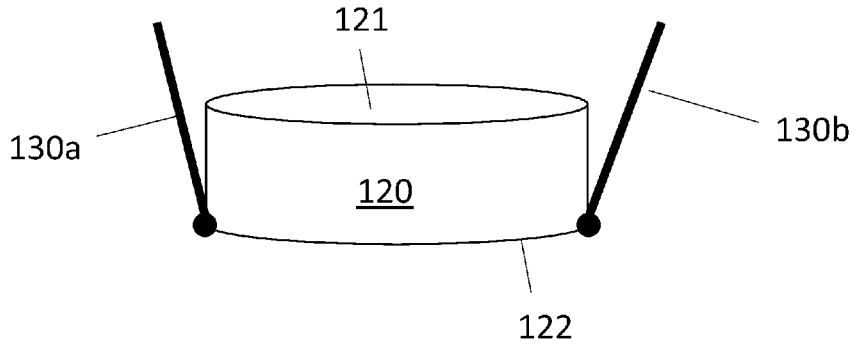
Figure 11G:
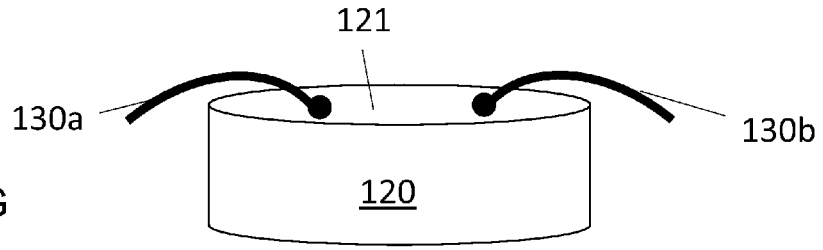

The second end (132) of the tether (130) may attach to any part of the insertion component (120). For example, as shown in FIG. 11B, in some embodiments, the second end (132) of the tether (130) attaches to the outer surface (125) of the insertion component (120) in the center of the insertion component (120). In some embodiments, the second end (132) of the tether (130) attaches to the outer surface (125) of the insertion component (120) at or near the top surface (121) of the insertion component (120). In some embodiments, the second end (132) of the tether (130) attaches to the outer surface (125) of the insertion component (125) at or near the bottom surface (122) of the insertion component (120). In some embodiments, the second end (132) of the tether (130) attaches to the top surface (121) of the insertion component (120). In some embodiments, the second end (132) of the tether (130) attaches to the bottom surface (122) of the insertion component (120).

The tethers (130) may attach anywhere to the outer component (110). For example, the tethers (130) may attach anywhere along the top surface (111) or the bottom surface (112) of the outer component 110), e.g., from the inner rim (119*a*) to the outer rim (119*b*). For example, in some embodiments, a tether (130) is attached to the top surface (111) of the outer component (110) at the inner rim (119*a*). In some embodiments, a tether (130) is attached to the top surface (111) of the outer component (110) at the outer rim (119*b*). In some embodiments, a tether (130) is attached to the top surface (111) of the outer component (110) at a location between the outer rim (119*b*) and the inner rim (119*a*), e.g., about halfway between the outer rim (119*b*) and inner rim (119*a*), between the inner rim (119*a*) and halfway between the outer rim (119*b*) and inner rim (119*a*), between the outer rim (119*b*) and halfway between the outer rim (119*b*) and the inner rim (119*a*), a quarter of the way in from the inner rim (119*a*) (as measured between the outer rim (119*b*) and inner rim (119*a*)), a quarter of the way in from the outer rim (119*b*) (as measured between the outer rim (119*b*) and inner rim (119*a*)), in between the outer rim (119*b*) and a quarter of the way in from the outer rim (119*b*), in between the inner rim (119*a*) and a quarter of the way in from the inner rim (119*a*), etc.

In some embodiments, a tether (130) is attached to the bottom surface (112) of the outer component (110) at the inner rim (119*a*). In some embodiments, a tether (130) is attached to the bottom surface (112) of the outer component (110) at the outer rim (119*b*). In some embodiments, a tether (130) is attached to the bottom surface (112) of the outer component (110) at a location between the outer rim (119*b*) and the inner rim (119*a*), e.g., about halfway between the outer rim (119*b*) and inner rim (119*a*), between the inner rim (119*a*) and halfway between the outer rim (119*b*) and inner rim (119*a*), between the outer rim (119*b*) and halfway between the outer rim (119*b*) and the inner rim (119*a*), a quarter of the way in from the inner rim (119*a*) (as measured between the outer rim (119*b*) and inner rim (119*a*)), a quarter of the way in from the outer rim (119*b*) (as measured between the outer rim (119*b*) and inner rim (119*a*)), in between the outer rim (119*b*) and a quarter of the way in from the outer rim (119*b*), in between the inner rim (119*a*) and a quarter of the way in from the inner rim (119*a*), etc.

The tether (130) may include but is not limited to a string, a rubber band, a piece of elastic, the like, or a combination thereof. The tether (130) may be stretchable. For example, in some embodiments, the tether (130) is constructed from a material comprising elastic. In some embodiments, the first end (131) and/or the second end (132) (or a portion of the first end and/or a portion of the second end (132)) of the tether (130) are covered, for example with foam. In some embodiments, the tether (130) is removably attached to the outer component (110) and/or the insertion component (120). In some embodiments, the tether (130) is a hook-and-loop fastener system.

A hinge (140) may connect the outer component (110) and the insertion component (120). In some embodiments, the hinge (140) forms a barrette (150). For example, the hinge (140) forms a first arm (151) and a second arm (152) of a barrette (150). In some embodiments, the insertion component (120) (e.g., the bottom surface (122)) is attached (e.g., fixed) to the first arm (151) of the barrette (150). The barrette (150) may be constructed in any appropriate shape, for example a butterfly, a heart, a flower, or other standard barrette shapes well known to one of ordinary skill in the art. To use the barrette (150) (with the present invention), a user can insert hair into the barrette (150), snap the barrette (150) down to clasp it shut, and a bun effect is created when the insertion component pushes some of the hair through the slot 118 in the outer component (110) when the barrette (150) is closed.

In some embodiments, the outer component (110) and the insertion component (120) are connected together via a hook-and-loop fastener. In some embodiments, the outer component (110) and the insertion component (120) are connected together via a hook-and-loop fastener on one side and a permanent connector on the other side.

In some embodiments, a bottom layer (112*a*) is disposed on the bottom surface (112) of the outer component (110). The bottom layer (112*a*) may be constructed from a material comprising foam, for example. In some embodiments, the first end (131*a*) of the first tether (130*a*) and the first end (131*b*) of the second tether (130*b*) engage the bottom layer (112*a*).

In some embodiments, the first tether (130*a*) is fixedly attached to the outer component (110) and the insertion component (120). In some embodiments, the second end (132*b*) of the second tether (130*b*) is fixedly attached to the insertion component (120) and the first end (131*b*) of the second tether (130*b*) is removably attached to the outer component (110) (or bottom layer (112*a*)) via an attachment means (e.g., a hook-and-loop fastener, a snap, a button, a cup, a magnet, the like, or a combination thereof). In some embodiments, the first end (131*b*) of the second tether (130*b*) is fixedly attached to the outer component (110) (or bottom layer (112*a*)) and the second end (132*b*) of the second tether (130*b*) is removably attached to the insertion component via an attachment means (e.g., a hook-and-loop fastener, a snap, a button, a dip, a magnet, the like, or a combination thereof).

Decor and Incorporation of Hair-Grabbing Components

Figure 4:
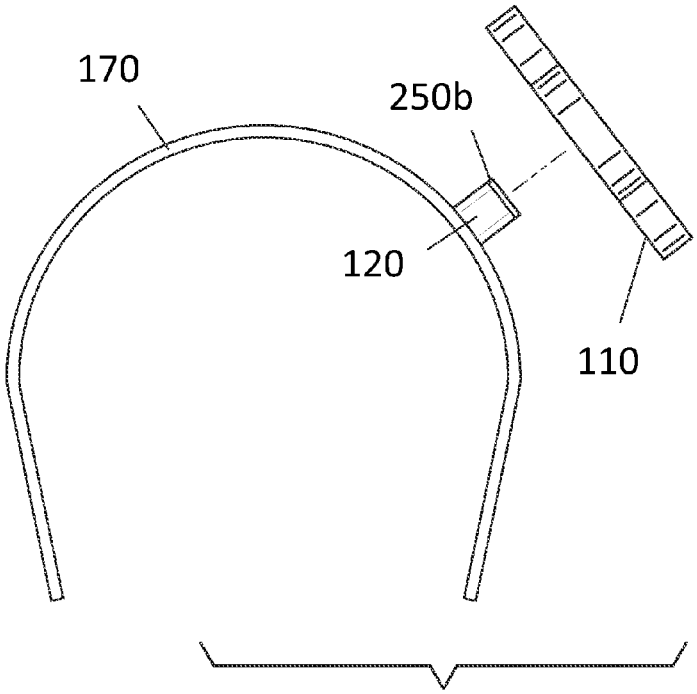
FIG. 4 is a side view of a system of the present invention.
Figure 5:
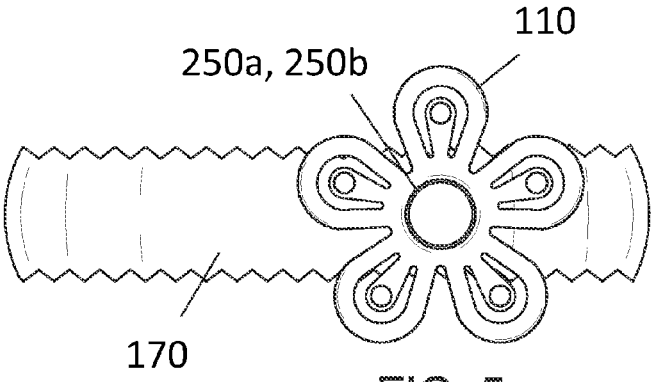
FIG. 5 is a top view of the system of FIG. 4.
Figure 6:
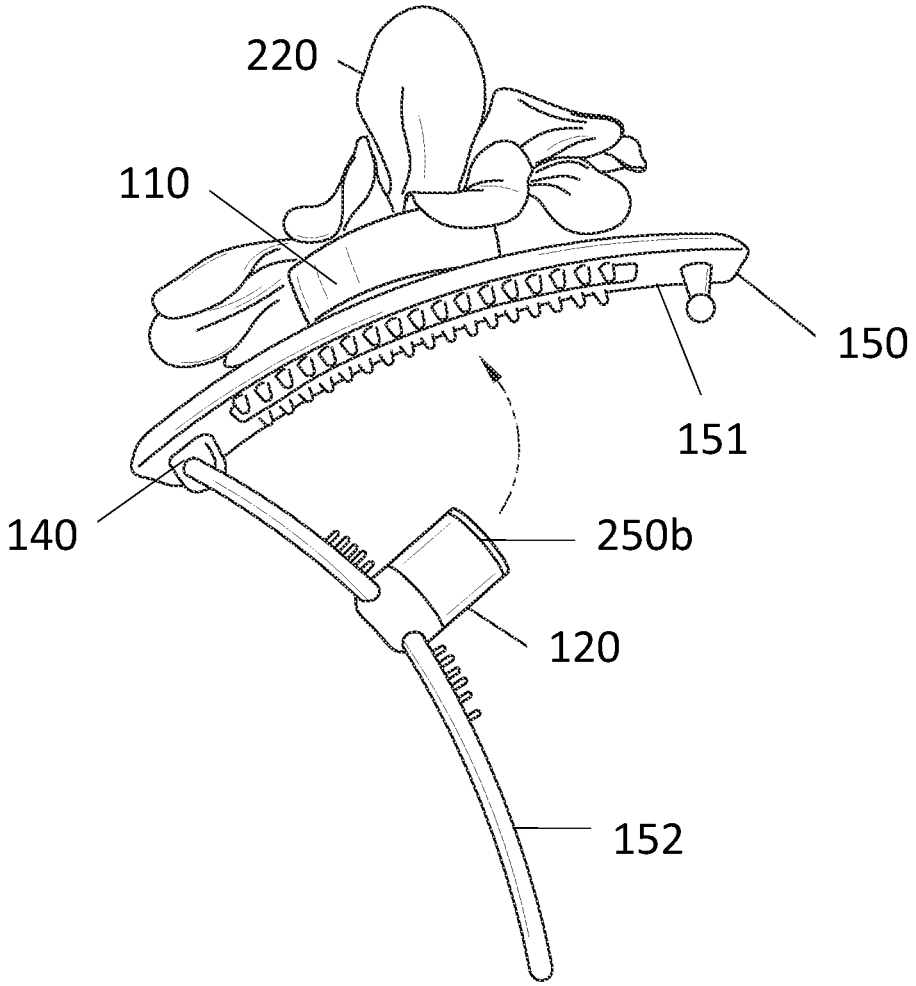
FIG. 6 is a perspective view of a system of the present invention.

One or more systems (100) (e.g., insertion components (120), outer components (110)) may be affixed to any additional hair system that can grab on to hair (hereinafter "hair-grab component" or "hair-grabbing component"). Non-limiting examples of hair-grabbing components include a headband, a ponytail holder, a comb, a hair dip, a barrette and the like. For example, as shown in FIG. 4 and FIG. 5, in some embodiments, the system (100), e.g., the insertion component (120), is attached (e.g., fixed) to a headband (170). In some embodiments, the system (100), e.g., the insertion component (120), is attached (e.g., fixed) to a comb. In some embodiments, the system (100), e.g., the insertion component (120), is attached (e.g., fixed) to a ponytail holder. As shown in FIG. 6, in some embodiments, the system (100), e.g., the insertion component (120), is attached (e.g., fixed) to a hair dip (or hair clasp).

Figure 16:
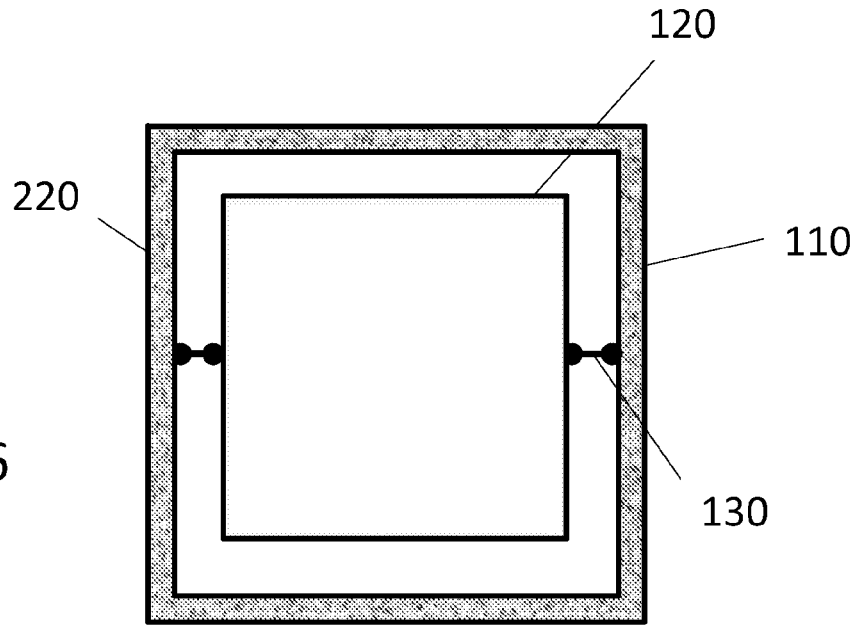
FIG. 16 and FIG. 17 show top views of systems of the present invention, wherein decorative components (glitter) are disposed on the top surface of the outer component.
Figure 17:
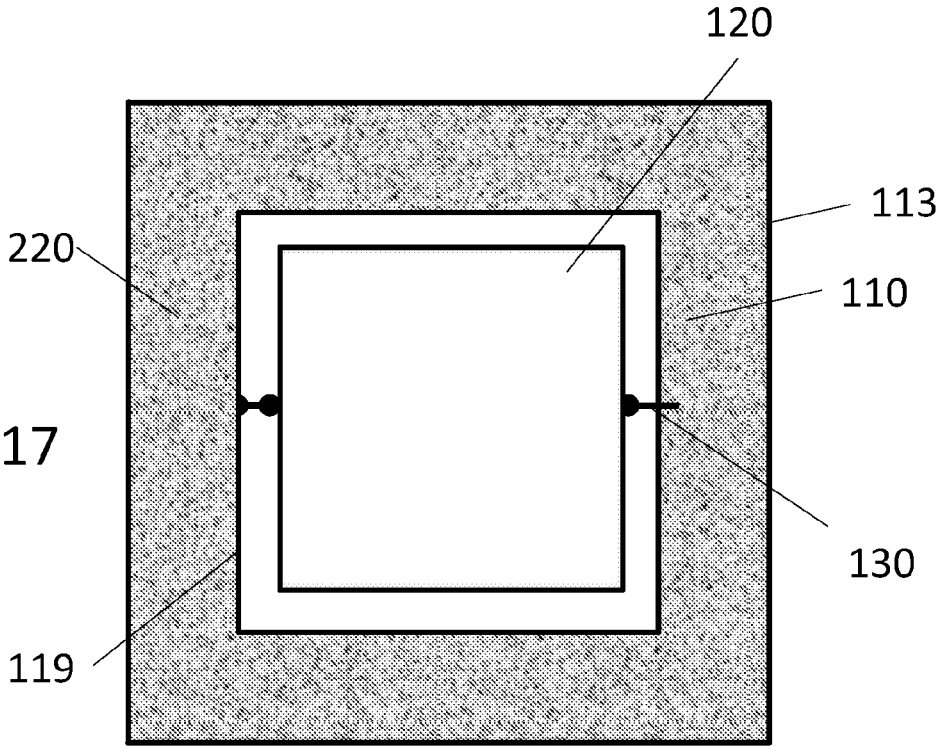
Figure 18A:
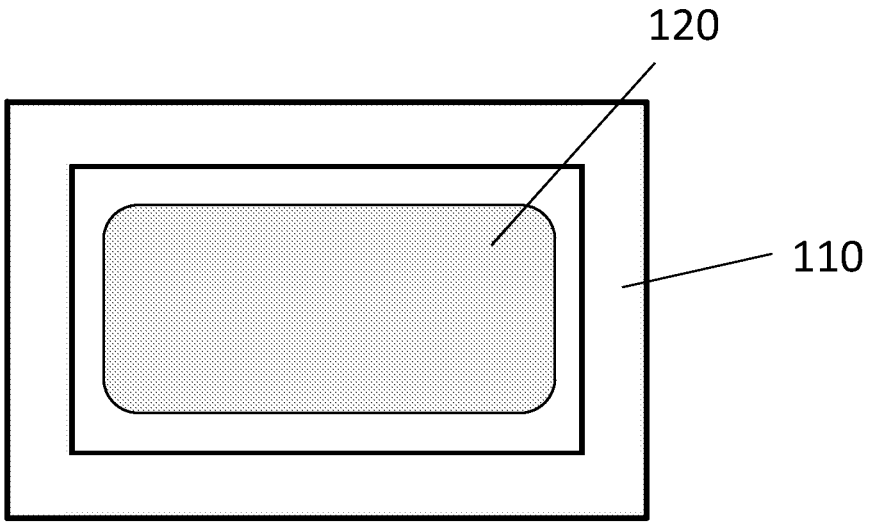
FIG. 18A and FIG. 18B show alternative shapes of systems of the present invention. For clarity, the tethers are not shown.
Figure 18B:
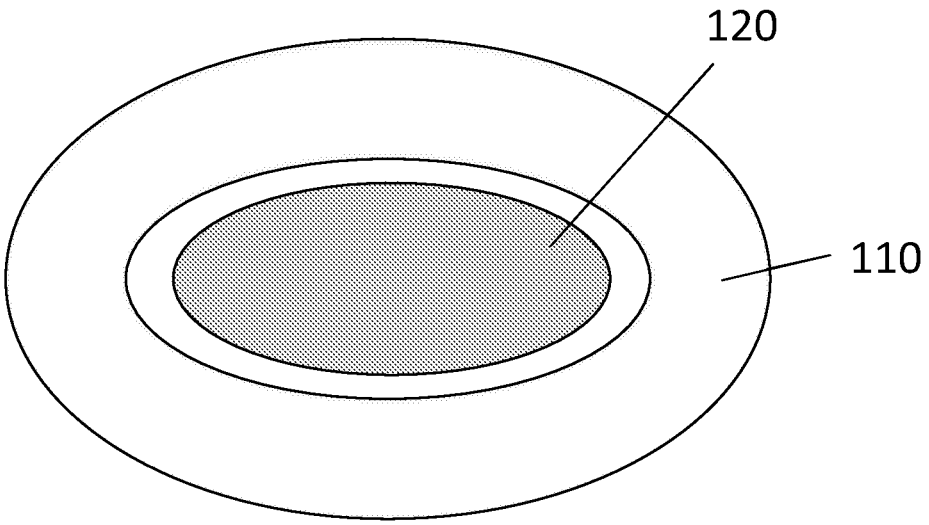
Figure 19:
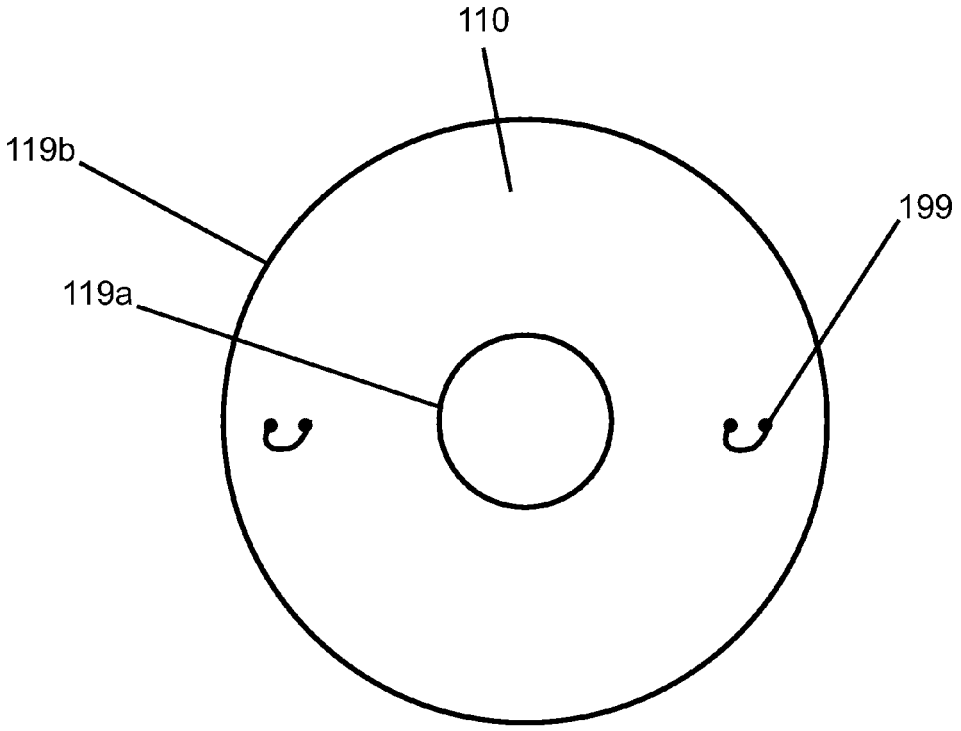
FIG. 19 shows an alternative embodiment of the system of the present invention, wherein tethers may be attached via hooks.
Figure 20A:
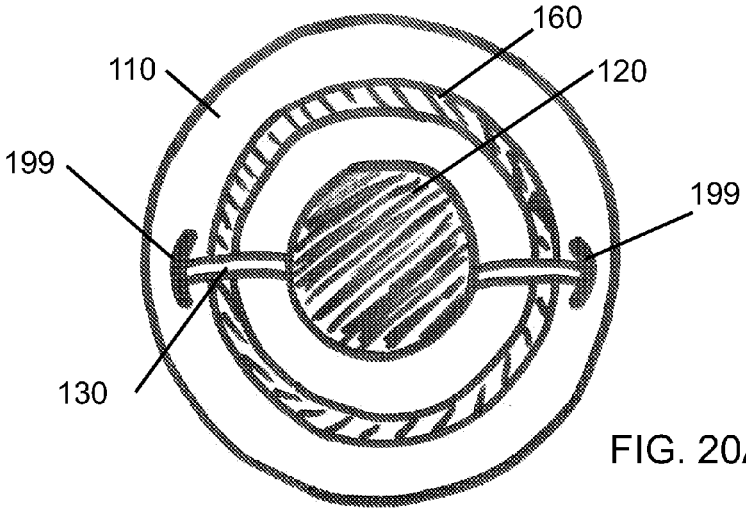
FIG. 20A-20D show alternative embodiments of the system of the present invention, wherein tethers may be attached via hooks.
Figure 20B:
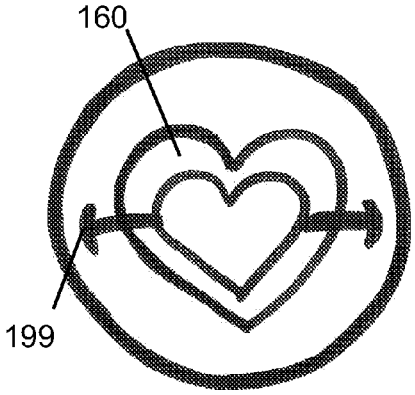
Figure 20C:
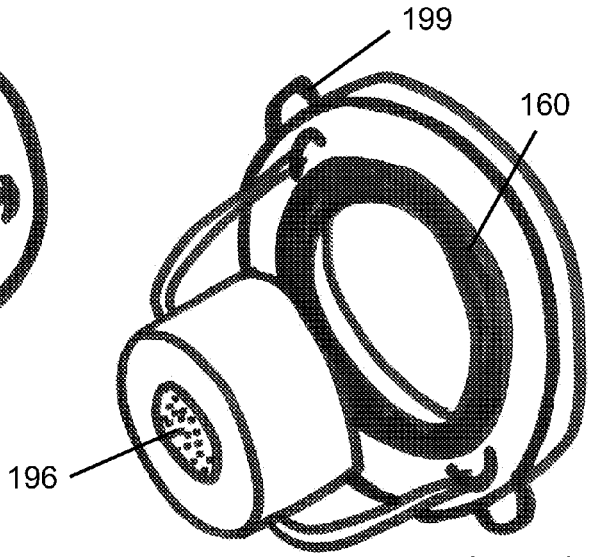
Figure 20D:
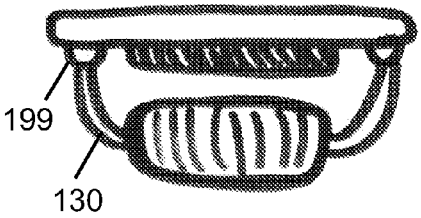

In some embodiments, a decorative component (220) is disposed on the outer component (110) or on the insertion component (120). A decorative component (220) may include but is not limited to a flower, a bead, a sticker, a glitter, a bow, a feather, or a combination thereof. FIG. 15 shows an example of heart-shaped beads disposed on the outer component (110). FIG. 16 shows an example of glitter disposed on the outer component (110). The decorative component may be disposed on the top surface (111) of the outer component (110), however the present invention is not limited to this configuration. For example, in some embodiments, the decorative component is disposed on the side surface (113) of the outer component and/or on the top surface (111) of the outer component (110).

In some embodiments, the outer component (110) comprises a snap-on addition. The snap-on addition allows a user to choose a particular design for the outer component (110). The snap-on additions are interchangeable. For example a user can attach a first snap-on addition, then remove the first snap-on addition and replace it with a second snap-on addition. In some embodiments, a snap component is disposed on the outer component (110) (e.g., the top surface) that engages the snap on-additions.

Sizing and Construction

The outer component (110) may be constructed in a variety of sizes. For example, in some embodiments, the outer component (110) is between about 1/16 to 1/8 inches in height as measured from the top surface (111) to the bottom surface (112). In some embodiments, the outer component (110) is between about 1/8 to 1/4 inches in height as measured from the top surface (111) to the bottom surface (112). In some embodiments, the outer component (110) is between about 1/4 to 1 inch in height as measured from the top surface (111) to the bottom surface (112). In some embodiments, the outer component (110) is more than 1 inch in height.

Figure 12A:
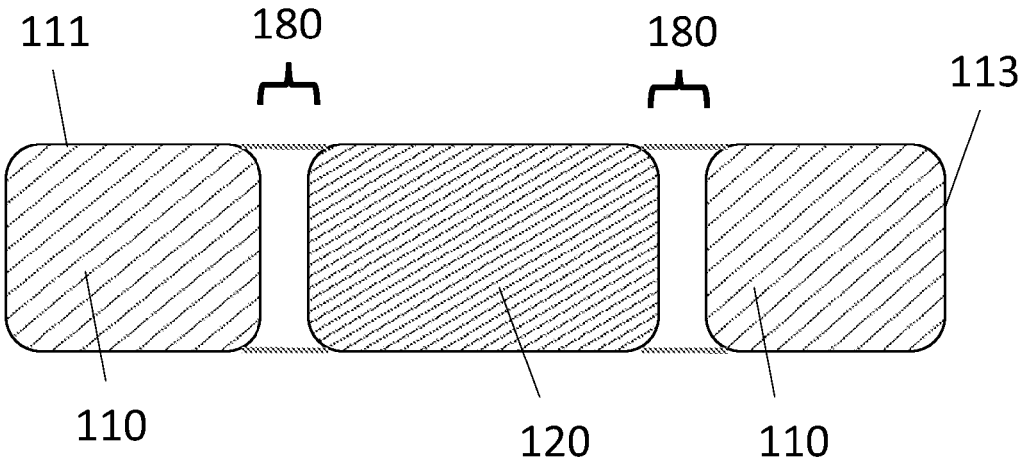
FIG. 12A-12B show side cross sectional views of various systems of the present invention. For clarity, the tethers are not shown.
Figure 12B:
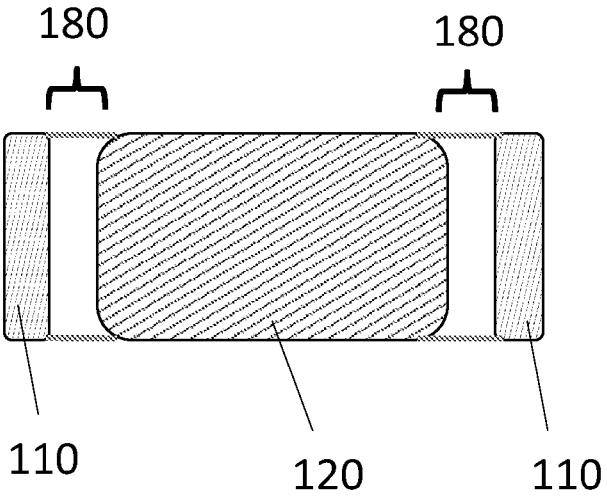
Figure 13A:
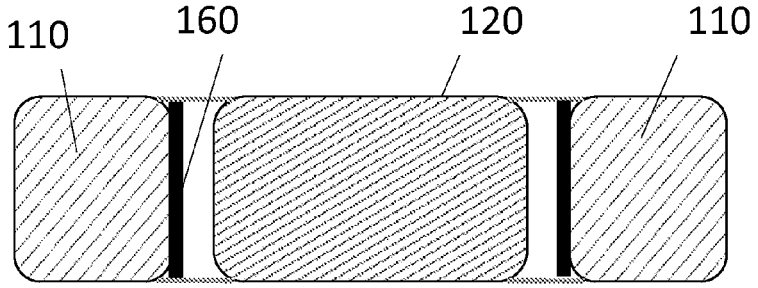
FIG. 13A-13D show side cross sectional views of various systems of the present invention. For clarity, the tethers are not shown.
Figure 13B:
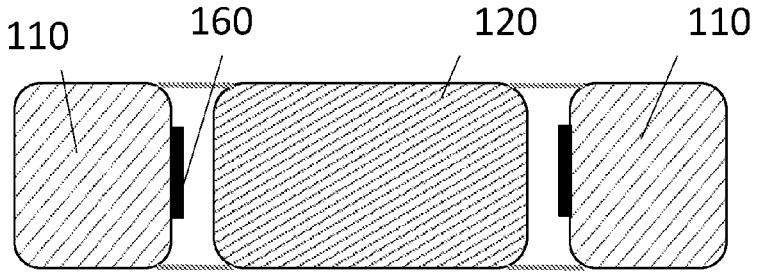
Figure 13C:
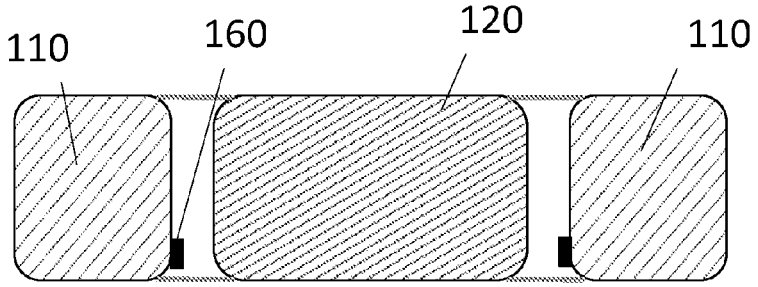
Figure 13D:
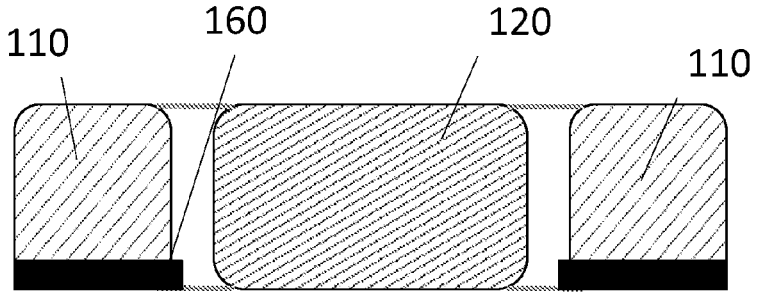
Figure 14A:
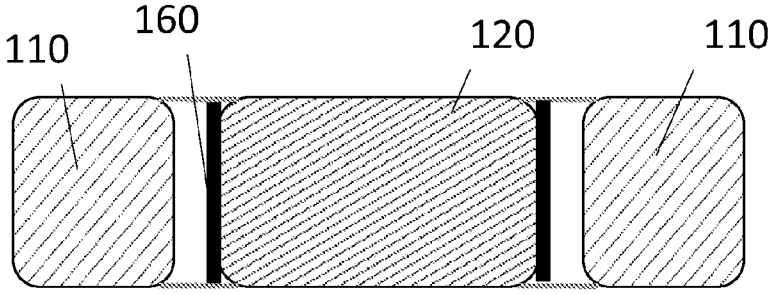
FIG. 14A-14D show side cross sectional views of various systems of the present invention. For clarity, the tethers are not shown.
Figure 14B:
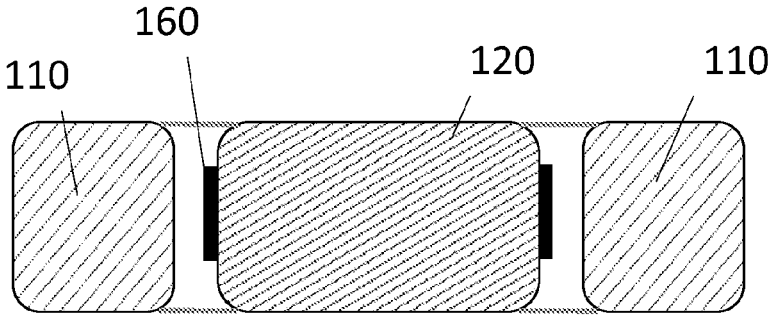
Figure 14C:
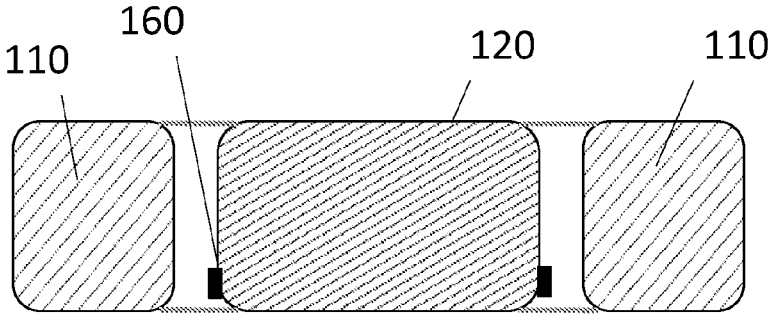
Figure 14D:
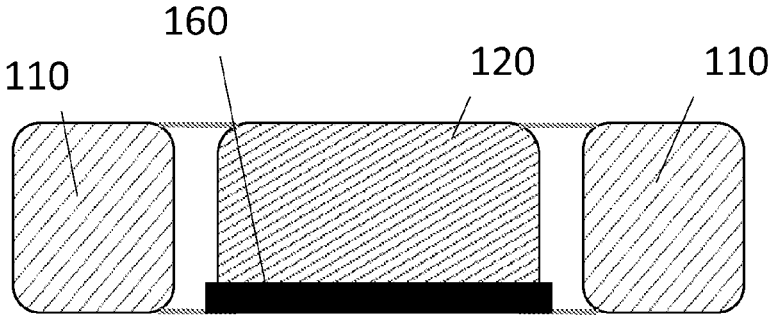

In some embodiments, the outer component (110) has a thin wall (e.g., distance between the slot surface (119) and the side surface (113)), for example as shown in FIG. 16 an in FIG. 12(B). In some embodiments, the outer component (110) has a thick wall (e.g., distance between the slot surface (119) and the side surface (113)), for example as shown in FIG. 16 and in FIG. 12(A). In some embodiments, the outer component (110) is between about 0.1 to 0.5 inches in thickness as measured from the slot surface (119) to the side surface (113). In some embodiments, the outer component (110) is between about 0.5 to 1 inch in thickness as measured from the slot surface (119) to the side surface (113). In some embodiments, the outer component (110) is more than about 1 inch in thickness as measured from the slot surface (119) to the side surface (113).

The insertion component (120) may be constructed in a variety of sizes. For example, in some embodiments, the insertion component (120) is between about 1/16 to 1/8 inches in height as measured from the top surface (121) to the bottom surface (122). In some embodiments, the insertion component (120) is between about 1/8 to 1/4 inches in height as measured from the top surface (121) to the bottom surface (122). In some embodiments, the insertion component (120) is between about 1/4 to 1 inch in height as measured from the top surface (121) to the bottom surface (122). In some embodiments, the insertion component (120) is more than 1 inch in height.

In some embodiments, the height of the outer component (110) is greater than the height of the inner component (110). In some embodiments, the height of the outer component (110) is less than the height of the inner component (110). In some embodiments, the height of the outer component (110) is about the same as the height of the inner component (110).

Generally, the insertion component (120) and the outer component (110) (when the insertion component is inserted into the slot (118) of the outer component (110)) are separated by a gap (180) (see FIG. 12). For example, the gap (180) is the space between the slot surface (119) of the outer component (110) and the outer surface (125) of the insertion component (120). The size of the gap (180) may vary. For example, in some embodiments, the gap (180) is between about 0.02 and 0.05 inches. In some embodiments, the gap (180) is between about 0.05 and 0.25 inches (e.g., 2 mm). In some embodiments, the gap (180) is greater than about 0.25 inches.

The outer component (110) and/or the insertion component (120) may be constructed from any appropriate material. In some embodiments, the outer component (110) is constructed from a soft and/or rigid foam. In some embodiments, the outer component (110) is constructed from a plastic or metal. In some embodiments, the insertion component (120) is constructed from a soft and/or rigid foam. In some embodiment, the insertion component (120) is constructed from a plastic or metal.

In some embodiments, the system (100) features a tactile reference (196) (as shown in FIG. 20). The tactile reference (196) can help a user orient the insertion component (120) properly. The tactile reference (196) may be constructed from a variety of materials. For example, in some embodiments, the tactile reference (196) is a divot. In some embodiments, the tactile reference (196) is constructed from a material comprising a hook-and-loop fastener component. The tactile reference (196) is not limited to the aforementioned configurations.

As used herein, the term "about" refers to plus or minus 10% of the referenced number. For example, an embodiment wherein the outer component (110) is about 1 inch in length includes an outer component (110) that is between 0.9 and 1.1 inches in length.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A hair holder system (100) comprising:

(a) an outer component (110) having a slot (118) disposed therein, the slot (118) has a slot surface (119);

(b) an insertion component (120) having an outer edge (125), the outer edge (125) can slidably insert into the slot (118) of the outer component (110), when the insertion component (120) is disposed within the slot (118), the slot surface (119) and the outer surface of the insertion component (120) can clamp and hold hair therein between, wherein a bun or puff effect is created for hair inserted therethrough in various shapes depending on a shape of the insertion component (120); and (c) a gripping component (160) disposed on at least a portion of one or both of the slot surface (119) of the outer component (110) or the outer surface (125) of the insertion component (120), the gripping component (160) functions to help secure the insertion component (120) within the slot (118) of the outer component when hair is inserted therethrough between the insertion component (120) and the outer component (110);

wherein the outer component (110) and insertion component (120) are connected together via a first pair of tethers (330*a*) and a second pair of tethers (330*a*), the first pair of tethers (330*a*) comprises a first tether (130*a*) and a third tether (130*c*), the second pair of tethers (330*b*) comprises a second tether (130*b*) and a fourth tether (130*d*), the first pair of tethers (330*a*) is positioned opposite the second pair of tethers (330*b*);

wherein a first end (131*a*) of the first tether (130*a*) is attached to the bottom surface (112) of the outer component (110) adjacent to an inner rim (119*a*) of the outer component (110) and a second end (132*a*) of the first tether (130*a*) is attached to the outer edge (125) of the insertion component (120), and a first end (131*c*) of the third tether (130*c*) is attached to the bottom surface (112) of the outer component (110) adjacent to the inner rim (119*a*) of the outer component (110) and a second end (132*c*) of the third tether (130*c*) is attached to the outer edge (125) of the insertion component (120), wherein a first end (131*b*) of the second tether (130*b*) is attached to the bottom surface (112) of the outer component (110) adjacent to the inner rim (119*a*) of the outer component (110) and a second end (132*b*) of the second tether (130*b*) is attached to the outer edge (125) of the insertion component (120), and a first end (131*d*) of the fourth tether (130*d*) is attached to the bottom surface (112) of the outer component (110) adjacent to the inner rim (119*a*) of the outer component (110) and a second end (132*d*) of the fourth tether (130*d*) is attached to the outer edge (125) of the insertion component (120).

2. The system (100) of claim 1, wherein the gripping component (160) is constructed from a material comprising foam, elastic, mesh, or a hook-and-loop fastener component.

3. The system (100) of claim 1, wherein the gripping component (160) is disposed on the slot surface (119) in between a top surface (111) and a bottom surface (112) of the outer component (110).

4. The system (100) of claim 1, wherein the gripping component (160) is disposed on the slot surface (119) of the outer component (110) near or at a bottom surface (112) of the outer component (110).

5. The system (100) of claim 1, wherein the gripping component (160) is disposed on the outer surface (125) in between a top surface (121) and a bottom surface (122) of the insertion component (120).

6. The system (100) of claim 1, wherein the gripping component (160) is disposed on the outer surface (125) of the insertion component (120) near or at a bottom surface (122) of the insertion component (120).

7. The system (100) of claim 1 further comprising a decorative component (220) disposed on a top surface (111) of the outer component (110).

8. The system (100) of claim 1, wherein the outer component (110) is between about 0.1 to 0.5 inches in thickness as measured from the slot surface (119) to a side surface (113).

9. The system (100) of claim 1, wherein the outer component (110) is between about 0.5 to 1 inch in thickness as measured from the slot surface (119) to a side surface (113).

10. The system (100) of claim 1, wherein a gap (180) is disposed between the slot surface (119) of the outer component (110) and the outer surface (125) of the insertion component (120), the gap (180) is between about 0.05 and 0.25 inches.

11. A hair holder system (100) comprising:

(a) an outer component (110) having a slot (118) disposed therein, the slot (118) has a slot surface (119);

(b) an insertion component (120) having an outer edge (125), the outer edge (125) can slidably insert into the slot (118) of the outer component (110), when the insertion component (120) is disposed within the slot (118), the slot surface (119) and the outer surface of the insertion component (120) can clamp and hold hair therein between, wherein a bun or puff effect is created for hair inserted therethrough in various shapes depending on a shape of the insertion component (120); and (c) a gripping component (160) disposed on at least a portion of one or both of the slot surface (119) of the outer component (110) or the outer surface (125) of the insertion component (120), the gripping component (160) functions to help secure the insertion component (120) within the slot (118) of the outer component when hair is inserted therethrough between the insertion component (120) and the outer component (110); and (d) a first tether (130*a*) and a second tether (130*b*) that both connect the outer component (110) and the insertion component (120), wherein a first end (131*a*) of the first tether (130*a*) is attached anywhere to the outer component (110) and a second end (132*a*) of the first tether (130*a*) is attached anywhere to the insertion component (120), a first end (131*b*) of the second tether (130*b*) is attached anywhere to the outer component (110), and a second end (132*b*) of the second tether (130*b*) is attached anywhere to the insertion component (120);

wherein the first tether (130*a*) and second tether (130*b*) are positioned opposite each other.

* * * * *